US010869556B2

(12) United States Patent
Alletto, Jr.

(10) Patent No.: US 10,869,556 B2
(45) Date of Patent: Dec. 22, 2020

(54) BACKREST PILLOW

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 15/373,078

(22) Filed: Dec. 8, 2016

(65) Prior Publication Data

US 2017/0164754 A1 Jun. 15, 2017

Related U.S. Application Data

(60) Provisional application No. 62/267,625, filed on Dec. 15, 2015.

(51) Int. Cl.
*A47C 20/02* (2006.01)
*A47C 31/00* (2006.01)
(Continued)

(52) U.S. Cl.
CPC ..... *A47C 20/027* (2013.01); *A47C 7/425* (2013.01); *A47C 20/023* (2013.01); *A47C 27/22* (2013.01);
(Continued)

(58) Field of Classification Search
CPC ..... A47G 9/10; A47G 9/1072; A47G 9/1081; A47G 9/109; A47G 9/1054; A47G 9/1036;
(Continued)

(56) References Cited

U.S. PATENT DOCUMENTS 168,126 A * 9/1875 Barker ..... A47G 9/10 5/645
2,959,794 A * 11/1960 Souleles ..... A47C 20/026 5/725
(Continued)

FOREIGN PATENT DOCUMENTS

FR 2576500 8/1986
GB 333738 8/1930
(Continued)

OTHER PUBLICATIONS

International application No. PCT/US2016/065595 Written Opinion of the International Search Authority, European Patent Office, dated Feb. 26, 2014 and.
(Continued)

*Primary Examiner* — Nicholas F Polito
*Assistant Examiner* — Morgan J McClure
(74) *Attorney, Agent, or Firm* — Sorell, Lenna & Schmidt, LLP

(57) ABSTRACT

A pillow is provided that includes a back section having opposite front and back surfaces that each extend between opposite top and bottom surfaces. The surfaces each extend between opposite first and second side surfaces. The pillow includes spaced apart first and second arms that each extend outwardly from the front surface. The first arm has an inner surface and an opposite outer surface that is continuous with the first side surface. The second arm has an inner surface and an opposite outer surface that is continuous with the second side surface. The inner surfaces are continuous with the front surface. The top surface and the side surfaces each include a first portion comprising a first material and a second portion comprising a second material that is different from the first material.

20 Claims, 9 Drawing Sheets

(51) Int. Cl.

| | |
|---|---|
| ***A47C 27/22*** | (2006.01) |
| ***A47C 7/42*** | (2006.01) |
| ***A47C 31/11*** | (2006.01) |
| ***A47G 9/10*** | (2006.01) |

(52) U.S. Cl.
CPC ..... *A47C 31/006* (2013.01); *A47C 31/116* (2013.01); *A47G 9/1036* (2013.01); *A47G 9/1072* (2013.01); *A47G 9/10* (2013.01); *A47G 9/109* (2013.01); *A47G 2009/1018* (2013.01)

(58) Field of Classification Search
CPC ..... A47G 2009/1018; A47C 20/027; A47C 7/383; A47C 20/02; A47C 20/025; A47C 20/023; A47C 7/425; A47C 7/405; A47C 31/006; A47C 31/116; A47C 27/22
See application file for complete search history.

(56) References Cited

U.S. PATENT DOCUMENTS

D207,248 S * 3/1967 Morse ..... D6/601
4,060,863 A * 12/1977 Craig ..... A47C 20/027 5/636
4,345,347 A * 8/1982 Kantor ..... A47C 7/383 5/490
4,768,248 A * 9/1988 O'Sullivan ..... A47G 9/10 5/640
5,038,432 A * 8/1991 Robillard ..... A47G 9/10 5/645
D336,456 S * 6/1993 Finch ..... D12/400
D339,950 S * 10/1993 Jung ..... D6/596
5,423,098 A * 6/1995 Swezey ..... A47C 20/027 297/410
D359,870 S * 7/1995 McLaughlin ..... D23/304
D373,275 S * 9/1996 Bell ..... D6/601
D376,503 S * 12/1996 Petersson ..... D6/596
D419,024 S * 1/2000 Lenahan ..... D6/601
D427,833 S * 7/2000 Robinson ..... D6/601
D431,143 S * 9/2000 Sekelsky ..... D6/601
D444,981 S * 7/2001 Hall ..... D6/333
6,408,468 B1 * 6/2002 Comfort ..... A47G 9/10 5/498
6,499,164 B1 * 12/2002 Leach ..... A47C 20/021 5/630
D550,495 S * 9/2007 Boutin ..... D6/601
7,284,290 B1 * 10/2007 Swezey ..... A47C 20/027 5/630
D594,264 S * 6/2009 Crocker ..... D6/601
D619,402 S * 7/2010 Sternlight ..... D6/601
D675,855 S * 2/2013 Reeves ..... D6/601
D699,982 S * 2/2014 Fair ..... A47D 13/083 D6/601
8,931,127 B1 * 1/2015 Moses ..... A47C 27/142 2/65
9,167,922 B1 * 10/2015 Holbrook ..... A47G 9/10
9,167,923 B1 * 10/2015 Holbrook ..... A47G 9/0253
9,247,837 B1 * 2/2016 Blake ..... A47G 9/1081
9,265,369 B1 * 2/2016 Beliveau ..... A47G 9/1036
D761,595 S * 7/2016 Pulver ..... D6/601
D786,584 S * 5/2017 Beliveau ..... D6/601
D787,860 S * 5/2017 Goddard ..... D6/601
D790,880 S * 7/2017 Wong ..... D6/601
D791,508 S * 7/2017 Chen ..... D6/601
D811,775 S * 3/2018 Yaish ..... D6/601
D815,861 S * 4/2018 Kassab Arabo ..... D6/601
2001/0003219 A1 * 6/2001 Chou ..... A47G 9/0253 5/636
2001/0029630 A1 * 10/2001 Cortese ..... A47G 9/1081 5/636
2001/0052153 A1 * 12/2001 Schwartz ..... A47C 7/725 5/905
2005/0150050 A1 * 7/2005 Wolf ..... A47C 7/383 5/636
2008/0010750 A1 * 1/2008 Tidwell ..... A47D 13/08 5/655
2009/0126117 A1 * 5/2009 Lazarus ..... A47G 9/0253 5/644
2009/0199341 A1 * 8/2009 Schantz ..... A47G 9/10 5/645
2010/0071134 A1 * 3/2010 Funatogawa ..... A47G 9/10 5/636
2010/0235992 A1 * 9/2010 Bensoussan ..... A47D 13/08 5/424
2011/0119833 A1 * 5/2011 Clark ..... A47D 13/083 5/655
2012/0009844 A1 * 1/2012 Waters ..... A47D 7/00 446/369
2013/0232695 A1 * 9/2013 Koci ..... A47G 9/1081 5/640
2013/0263377 A1 * 10/2013 Wootten, Jr. ..... A47C 23/00 5/640
2014/0007351 A1 * 1/2014 Cohen ..... A47G 9/10 5/639
2014/0189955 A1 * 7/2014 Alletto, Jr. ..... A47G 9/1027 5/636
2014/0196216 A1 * 7/2014 Weitzel ..... A61G 7/057 5/691
2014/0223664 A1 * 8/2014 Kanbar ..... A47G 9/10 5/636
2014/0310877 A1 * 10/2014 Sternlight ..... A47G 9/10 5/639
2015/0074911 A1 * 3/2015 Dungan ..... A47G 9/1036 5/636
2015/0173524 A1 * 6/2015 McQuilton ..... A47C 20/02 5/652.1
2016/0143464 A1 * 5/2016 Waters ..... A63H 33/006 5/636
2016/0157644 A1 * 6/2016 Holbrook ..... A47G 9/10 5/638
2017/0042352 A1 * 2/2017 Atkinson ..... A47G 9/1081
2017/0055737 A1 * 3/2017 Rochlin ..... A47G 9/10
2017/0251813 A1 * 9/2017 Komsky ..... A47C 7/383
2017/0347815 A1 * 12/2017 Moeller ..... A47G 9/0253
2018/0146807 A1 * 5/2018 Silver ..... A47G 9/1045
2018/0199738 A1 * 7/2018 Klein ..... A47G 9/0253

FOREIGN PATENT DOCUMENTS

WO 2012078596 A2 6/2012
WO WO-2012078596 A2 * 6/2012 ..... A47C 20/027
WO 2012/078596 6/2014

OTHER PUBLICATIONS

International Search Report, European Patent Office, dated Feb. 26, 2014.
International Preliminary Report on Patentability and Written Opinion of the International Searching Authority, European Patent Office, PCT/US2016/065595, dated Jun. 28, 2018.

* cited by examiner

BACKREST PILLOW

TECHNICAL FIELD

The present disclosure generally relates to bedding, and more particularly to pillows adapted to provide ventilation to prevent heat buildup within the pillow.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable, in order to achieve restful sleep.

When people sleep or rest, at least part of the person's body, such as, for example, his or her back or neck, contacts a portion of a pillow, causing the pillow to accumulate heat. If unable to escape, the heat will build up within the pillow and will increase the temperature of the portion of the person's body that contacts the pillow, thus leading to discomfort. Such discomfort will often disrupt the person's sleep or rest. This disclosure describes an improvement over these prior art technologies.

SUMMARY

In one embodiment, in accordance with the principles of the present disclosure, a pillow is provided. The pillow includes a back section having opposite front and back surfaces that each extend between opposite top and bottom surfaces. The surfaces each extend between opposite first and second side surfaces. The pillow includes spaced apart first and second arms that each extend outwardly from the front surface. The first arm has an inner surface and an opposite outer surface that is continuous with the first side surface. The second arm has an inner surface and an opposite outer surface that is continuous with the second side surface. The inner surfaces are continuous with the front surface. The top surface and the side surfaces each include a first portion comprising a first material and a second portion comprising a second material that is different from the first material.

In one embodiment, in accordance with the principles of the present disclosure, the back section has a height that is greater than that of the arms. The first portion of the top surface is positioned equidistant between the first and second side surfaces and extends into the front surface. The first portions of the side surfaces each extend from the top surface to the bottom surface. The first material includes 3D mesh fabric comprising 100% polyester and the second material includes a 100% polyester fabric. In the alternative, the first material including the 3D mesh fabric and the second material can be made from the same or different materials selected form the group consisting of acrylic, acetate, cotton, linen, silk, polyester, wool, nylon, rayon, spandex, lycra, hemp, manmade materials, natural materials (e.g., hemp) and blends thereof. Particular materials or blends of materials used are selected according the particular characteristics, price point, durability, and appearance to be achieved.

The pillow comprises a first mesh pocket that extends from the first portion of the first side surface to a lateral end surface of the first arm and a second mesh pocket that extends from the first portion of the second side surface to a lateral end surface of the second arm. The lateral end surface of the first arm extends from the inner surface of the first arm to the outer surface of the first arm. The lateral end surface of the second arm extends from the inner surface of the second arm to the outer surface of the second arm. The inner surfaces include the first material. The first material has a porosity that is greater than that of the second material. The pillow is configured such that air moves into an interior cavity of the pillow through the first portions of the top surface and the inner surfaces and exits the cavity through the first portions of the side surfaces.

In one embodiment, in accordance with the principles of the present disclosure, the pillow is a travel pillow wherein the back section is configured to support a user's neck and the arms are configured to rest on the user's shoulders as the back section supports the user's neck. In some embodiments, the travel pillow comprises a flexible band within the travel pillow configured to correct a position of the user's body frame. In some embodiments, the flexible band extends through the back section and each of the arms. In some embodiments, the travel pillow comprises a plurality of interior pockets, at least one of the interior pockets being filled with a first fill material and at least one of the interior pockets being filled with a second fill material that is different from the first material. In some embodiments, the travel pillow comprises a suction cup coupled to the outer surface thereof.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
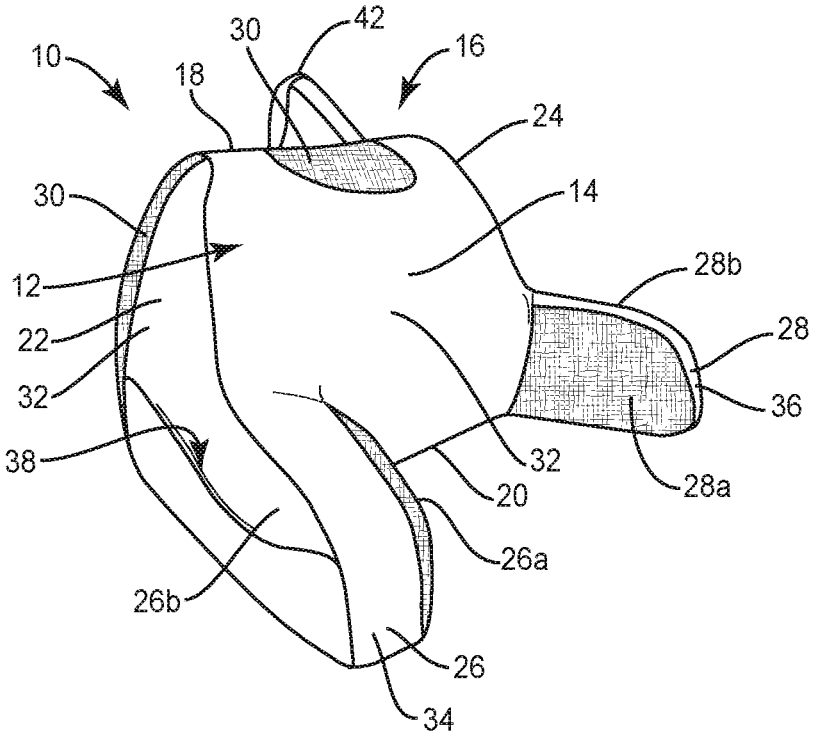
FIG. 1 is a perspective view of one embodiment of a pillow in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a pillow in accordance with the principles of the present disclosure. Alternate embodiments are also disclosed. Reference will now be made in detail to the exemplary embodiments of the present disclosure, which are illustrated in the accompanying figures. Turning to FIGS. 1-6, there are illustrated components of a pillow 10.

Pillow 10 includes a back section 12 comprising opposite front and back surfaces 14, 16 that each extend between opposite top and bottom surfaces 18, 20. Surfaces 14, 16, 18, 20 each extend between opposite first and second side surfaces 22, 24. Front surface 14 faces away from back surface 16; top surface 18 faces away from bottom surface 20; and first side surface 22 faces away from second side surface 24.

Figure 2:
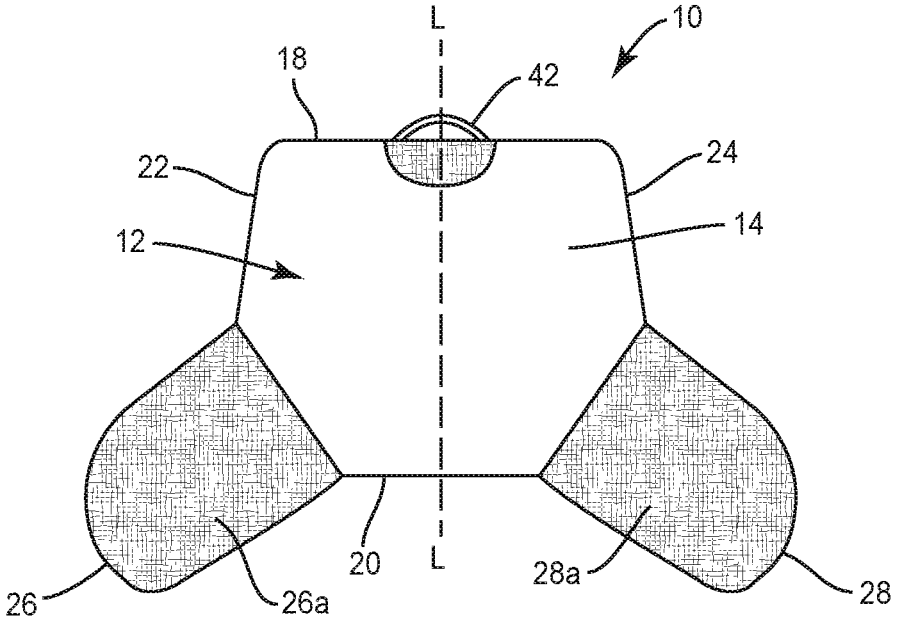
FIG. 2 is a front view of the pillow shown in FIG. 1.
Figure 3:
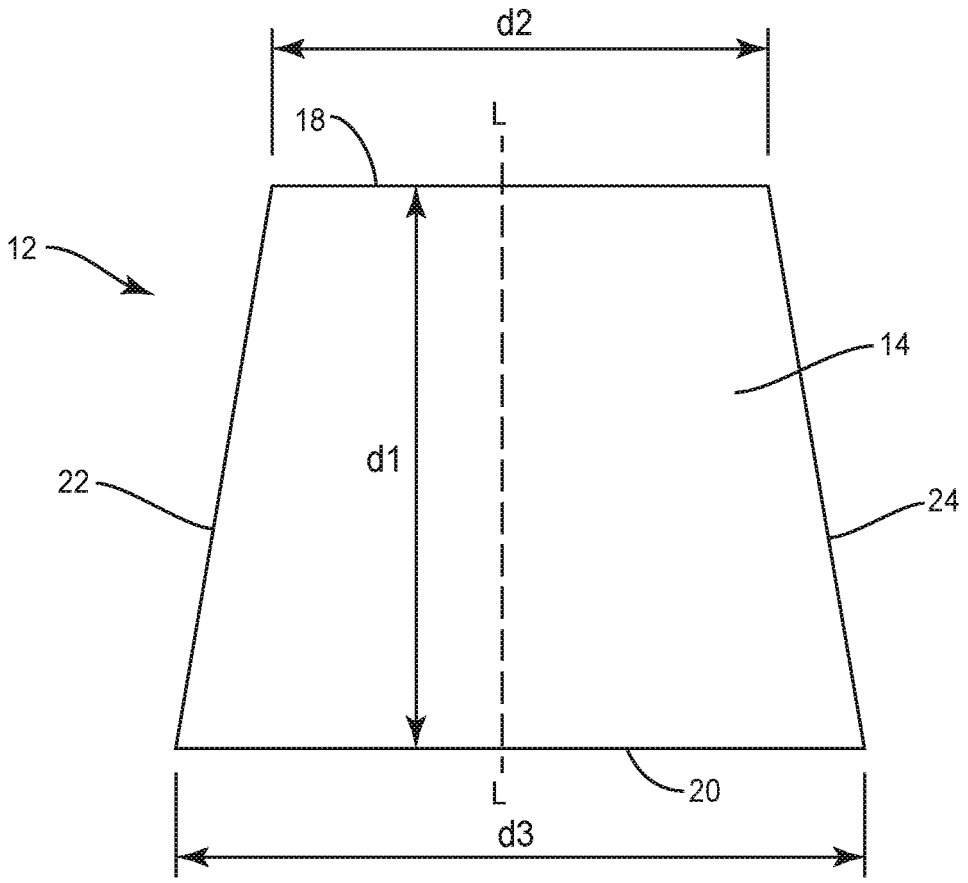
FIG. 3 is a front view of a component of the pillow shown in FIG. 1.
Figure 4:
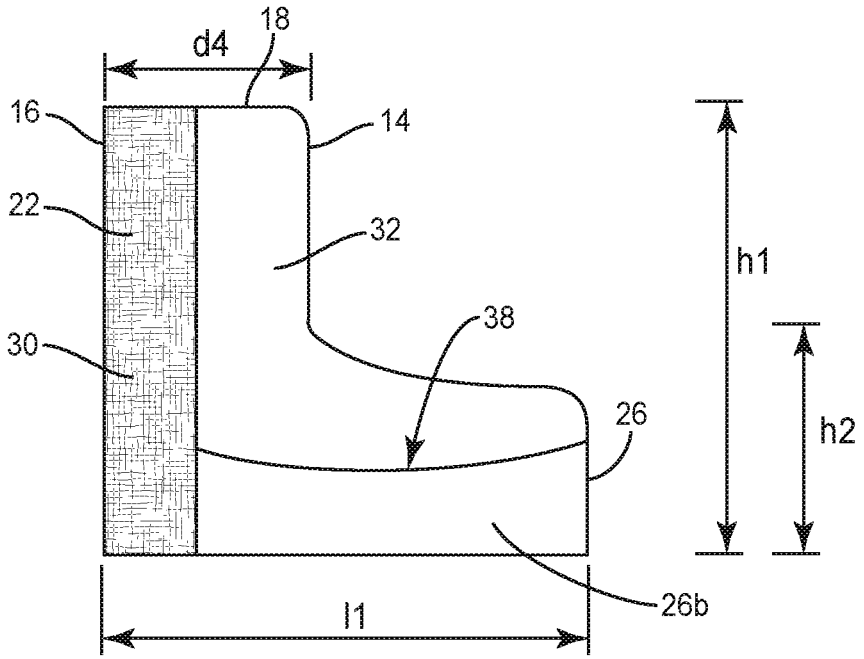
FIG. 4 is a side view of the pillow shown in FIG. 1.

Back section 12 extends along a longitudinal axis L between top and bottom surfaces 18, 20, as shown in FIGS. 2 and 3. In some embodiments, top surface 18 is spaced apart from bottom surface 20 along longitudinal axis L a distance d1, as shown in FIG. 3. In some embodiments, distance d1 is between about 8 inches and about 32 inches. In some embodiments, distance d1 is about 20 inches. In some embodiments, top surface 18 extends a distance d2 from first side surface 22 to second side surface 24 in a direction that is perpendicular to longitudinal axis L, as shown in FIG. 3. In some embodiments, distance d2 is between about 6 inches and about 18 inches. In some embodiments, distance d2 is about 12.25 inches. In some embodiments, bottom surface 20 extends a distance d3 from first side surface 22 to second side surface in a direction that is perpendicular to longitudinal axis L, as shown in FIG. 3. In some embodiments, distance d3 is greater than distance d2 such that front and back surfaces 14, 16 each have a width adjacent top surface 18 that is less than a width adjacent bottom surface 20. In some embodiments, distance d3 is between about 8 inches and about 32 inches. In some embodiments, distance d3 is about 20 inches. In some embodiments, back section 12 has a thickness defined by a distance d4 from front surface 14 to back surface 16, as shown in FIG. 4. In some embodiments, distance d4 is between about 4 inches and about 8 inches. In some embodiments, distance d4 is between about 6 inches.

In some embodiments, top and bottom surfaces 18, 20 each extend transverse to longitudinal axis L. In some embodiments, top and bottom surfaces 18, 20 each extend perpendicular to longitudinal axis L such that top and bottom surfaces 18, 20 extend parallel to one another. In some embodiments, first and second side surfaces 22, 24 each extend at an acute angle relative to longitudinal axis L. In some embodiments, first and second side surfaces 22, 24 each extend at an angle between 1° and 89° relative to longitudinal axis L. In some embodiments, surfaces 14, 16, 18, 20, 22, 24 may be disposed at alternate orientations, relative to longitudinal axis L, such as, for example, parallel, transverse, perpendicular and/or other angular orientations such as acute or obtuse, co-axial and/or may be offset or staggered.

Figure 5:
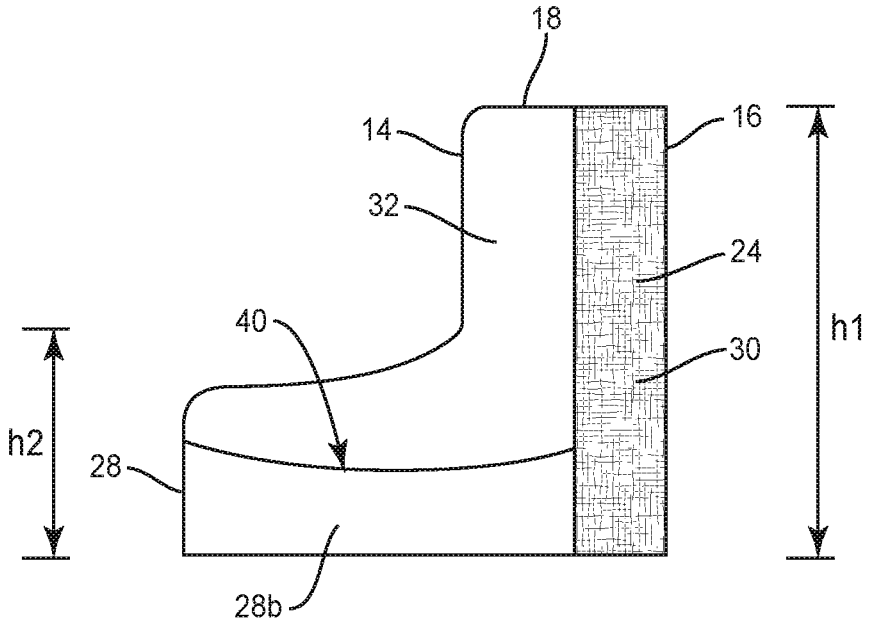
FIG. 5 is a side view of the pillow shown in FIG. 1.

Pillow 10 includes spaced apart first and second arms 26, 28 that each extend outwardly from front surface 14. That is, arms 26, 28 face away from back surface 16. First arm 26 comprises an inner surface 26*a* and an opposite outer surface 26*b* that is continuous with first side surface 22. Second arm 28 comprises an inner surface 28*a* and an opposite outer surface 28*b* that is continuous with second side surface 24. Inner surfaces 26*a*, 28*a* are continuous with front surface 14. In some embodiments, inner surface 26*a* extends continuously from front surface 14 to a lateral end surface 34 of arm 26. Lateral end surface 34 extends continuously from inner surface 26*a* to outer surface 26*b*. In some embodiments, inner surface 28*a* extends continuously from front surface 14 to a lateral end surface 36 of arm 28. Lateral end surface 36 extends continuously from inner surface 28*a* to outer surface 28*b*. In some embodiments, back section 12 has a height along longitudinal axis L that is greater than at least one of arms 26, 28. As shown in FIGS. 4 and 5, back section 12 has a height h1 along longitudinal axis L that is greater than a height h2 of each of arms 26, 28. In some embodiments, height h1 is between about 9 inches and about 27 inches. In some embodiments, height h1 is about 18 inches. In some embodiments, height h2 is between about 4 inches and about 14 inches. In some embodiments, height h2 is about 9 inches. In some embodiments, back section 12 and one of arms 26, 28 combine to define a length l1 of pillow 10, as shown in FIG. 4. In some embodiments, length l1 is between about 9 inches and about 21 inches. In some embodiments, length l1 is about 15 inches.

Top surface 18 and side surfaces 22, 24 each include a first portion 30 comprising a first material and a second portion 32 comprising a second material that is different from the first material, as best shown in FIG. 1. In some embodiments, top surface 18 and side surfaces 22, 24 each include one or a plurality of portions 30. In some embodiments, top surface 18 and side surfaces 22, 24 each include only one first portion 30 comprising the first material and the remaining sections or portions of top surface 18 and side surfaces 22, 24 comprise the second material. The remaining sections or portions of top surface 18 and side surfaces 22, 24 are free of the first material. That is, only the portions of top surface 18 and side surfaces 22, 24 designated as portions 30 comprise the first material, and the remaining sections or portions of top surface 18 and side surfaces 22, 24 do not comprise the first material. In some embodiments, the first material has a porosity that is greater than that of the second material such that air moves into an interior cavity of pillow 10 through first portion 30 of top surface 18 and exits the cavity through first portions 30 of side surfaces 22, 24. In some embodiments, the entire bottom surface 20 consists of the second material. That is, no portion of bottom surface 20 includes the first material. In some embodiments, the entire back surface 16 consists of the second material. That is, no portion of back surface 16 includes the first material.

In some embodiments, pillow 10 is sized and dimensioned for use as a backrest pillow wherein a user rests his or her back upon front surface 14 and rests his or her arms upon arms 26, 28. The user may position his or her neck or head upon portion 30 of top surface 18. As a user rests against pillow 10, heat from the user's body, such as, for example, at least one of the user's back, neck, head and arms, will enter the cavity via first portion 30 of top surface 18. Rather than remain trapped within the cavity, the heat escapes the cavity via first portions 30 of side surfaces 22, 24 to prevent heat from building up within the cavity. In some embodiments, this configuration allows heated air to move continuously through the cavity via first portion 30 of top surface 18 and first portions 30 of side surfaces 22, 24. Constant or continuous airflow through the cavity will prevent heat from building up within the cavity. In some embodiments, the first material has a porosity that is less than that of the second material.

In some embodiments, first portion 30 of the top surface 18 is positioned equidistant between first and second side surfaces 22, 24. In some embodiments, first portion 30 of the top surface 18 extends at least partially into front surface 14. In some embodiments, first portions 30 of side surfaces 22, 24 each extend continuously from top surface 18 to bottom surface 20. In some embodiments, the first material that forms portions 30 includes a mesh material. In some embodiments, the first material that forms portions 30 includes 3D mesh fabric comprising 100% polyester and/or the second material that forms portion 32 includes a 100% polyester fabric.

In some embodiments, inner surfaces 26*a*, 28*a* each include the first material. In some embodiments, inner surfaces 26*a*, 28*a* each consist of the first material. That is, no portion of either of inner surfaces 26*a*, 28*a* includes any material other than the first material. As stated above, in some embodiments, the first material has a porosity that is greater than that of the second material. This allows air, such as, for example, heated air to move into the interior cavity of pillow 10 through first portion 30 of top surface 18 and inner surfaces 26*a*, 28*a* and exit the cavity through first portions 30 of side surfaces 22, 24. That is, as a user rests against pillow 10, heat from the user's body will enter the cavity via first portion(s) 30 of top surface 18 and/or inner surfaces 26*a*, 28*a*. Rather than remain trapped within the cavity, the heated air escapes the cavity via first portions 30 of side surfaces 22, 24 to prevent heat from building up within the cavity. In some embodiments, this configuration allows heated air to move continuously through the cavity via first portion 30 of top surface 18 and/or inner surfaces 26*a*, 28*a* and first portions 30 of side surfaces 22, 24. Constant or continuous airflow through the cavity will prevent heat from building up within the cavity as no heated air will be contained within the cavity for enough time to increase the temperature of the cavity. In some embodiments, the entire outer surface 26*b* and the entire outer surface 28*b* each consist of the second material. That is, no portion of outer surface 26*b* or outer surface 28*b* includes the first material.

In some embodiments, best shown in FIGS. 4 and 5, pillow 10 comprises a first pocket 38 that extends from first portion 30 of first side surface 22 to lateral end surface 34 of first arm 26 and a second pocket 40 that extends from first portion 30 of second side surface 24 to lateral end surface 36 of second arm 28. In some embodiments, at least one of pockets 38, 40 comprises a mesh material. In some embodiments, at least one of pockets 38, 40 comprises the first material. In some embodiments, at least one of pockets 38, 40 comprises a material that is different than the first material and the second material.

In some embodiments, pillow 10 includes a handle 42 coupled to top surface 18 that is configured for lifting and/or carrying pillow 10. In some embodiments, handle 42 is positioned on portion 32 of top surface 18 and is spaced apart from portion 30 of top surface 18 so as to avoid impeding airflow in and/or out of the cavity of pillow 10 through portion 30 of top surface 18. In some embodiments, handle 42 comprises a mesh material. In some embodiments, handle 42 comprises the first material. In some embodiments, handle 42 comprises a material that is different than the first material and the second material. In some embodiments, handle 42 has a total length between about 10 inches and 13 inches. In some embodiments, handle 42 has a total length of about 11.5 inches.

In some embodiments, the inner cavity of pillow 10 includes a fill material positioned therein. In some embodiments, the fill material comprises a compliant material. In some embodiments, the fill material comprises a gel. In some embodiments, the fill material comprises memory foam, latex, or similar specialty support cushioning, man-made materials and combination thereof.

Figure 6:
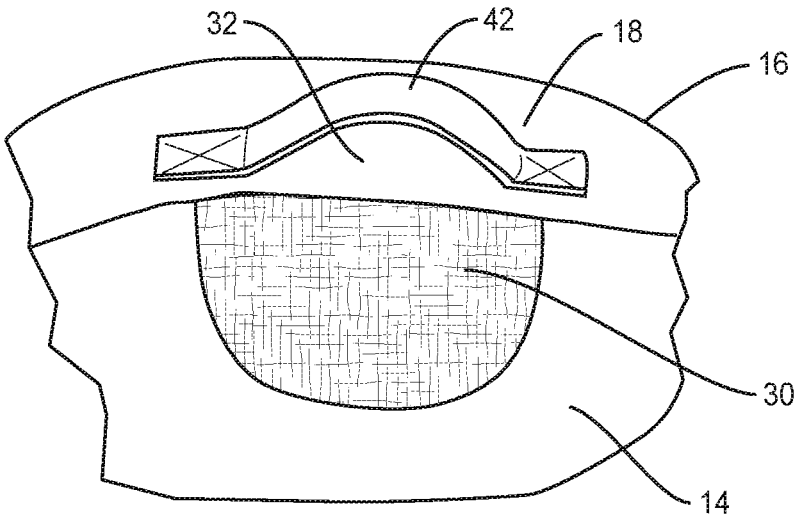
FIG. 6 is a top view of the pillow shown in FIG. 1.
Figure 6A:
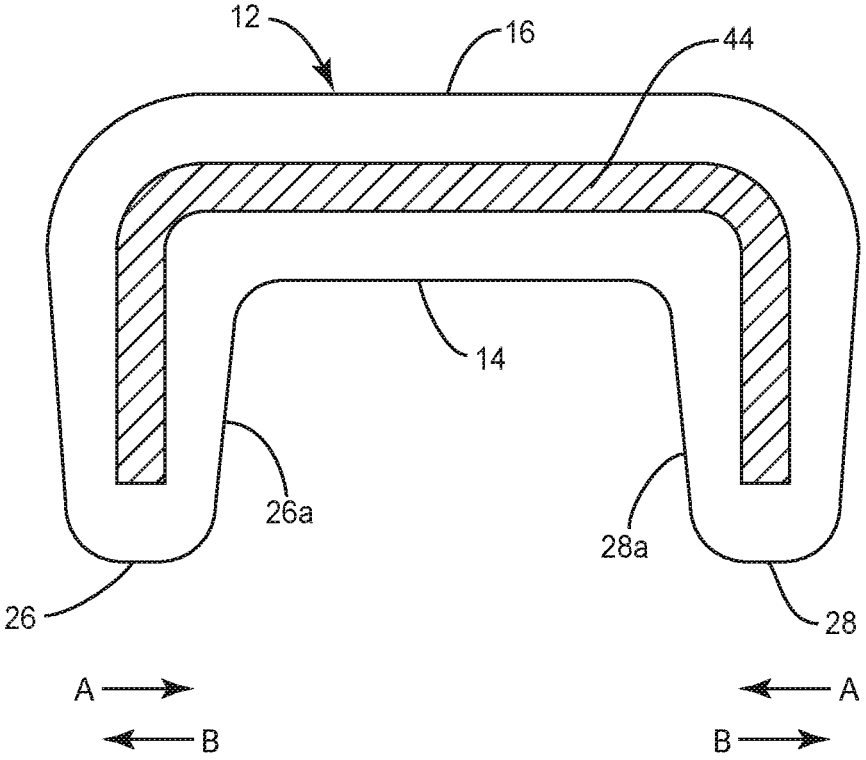
FIG. 6A is a top, cross sectional view of one embodiment of the pillow shown in FIG. 1, in accordance with the principles of the present disclosure.
Figure 7:
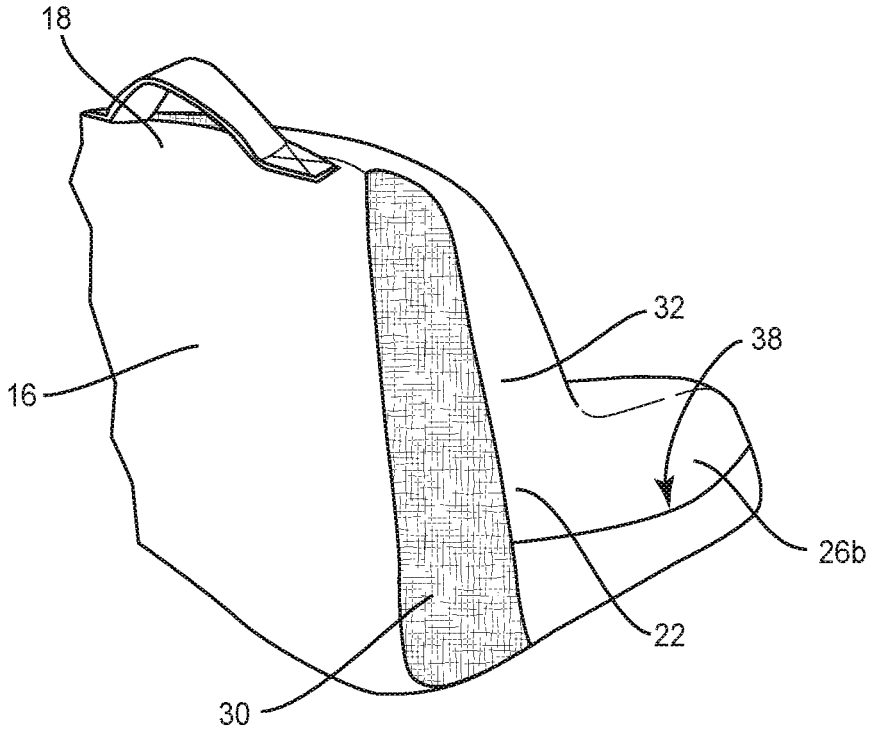
FIG. 7 is a side, perspective view of the pillow shown in FIG. 1.

In one embodiment, shown in FIG. 6A, pillow 10 comprises a flexible band 44 within pillow 10 configured to allow at least one of arms 26, 28 to move relative to back section 12 and remain in the moved position. For example, user's having a small body frame may desire to move at least one of arms 26, 28 toward the other one of arms 26, 28 so that arms 26, 28 touch his or her body. As such, at least one of arms 26, 28 may be moved relative to back section 12 in the directions shown by arrows A in FIG. 6A. Flexible band 44 will hold arm 26 and/or arm 28 in the moved position. Likewise, users having larger body frames may need to move at least one of arms 26, 28 relative to back section 12 in order to fit his or her body between arms 26, 28. As such, at least one of arms 26, 28 may be moved relative to back section 12 in the directions shown by arrows B in FIG. 6A. Flexible band 44 will hold arm 26 and/or arm 28 in the moved position. In some embodiments, flexible band 44 extends through back section 12 and arms 26, 28. In some embodiments, flexible band 44 extends parallel or substantially parallel to top surface 18. In some embodiments, flexible band 44 comprises a metal. In some embodiments, flexible band 44 comprises a metal wire, such as, for example, a copper wire.

In some embodiments, pillow 10 one or a plurality of suction cups is/are coupled to the outer surface of pillow 10. The suction cup(s) allow(s) pillow 10 to be attached to a surface, such as, for example a vertical surface, such as, for example, a wall or window. In one embodiment, at least one suction cup is coupled to arm 26. In one embodiment, at least one suction cup is coupled to arm 28. In one embodiment, at least one suction cup is coupled to top surface 18. In one embodiment, at least one suction cup is coupled to handle 42.

Figure 8:
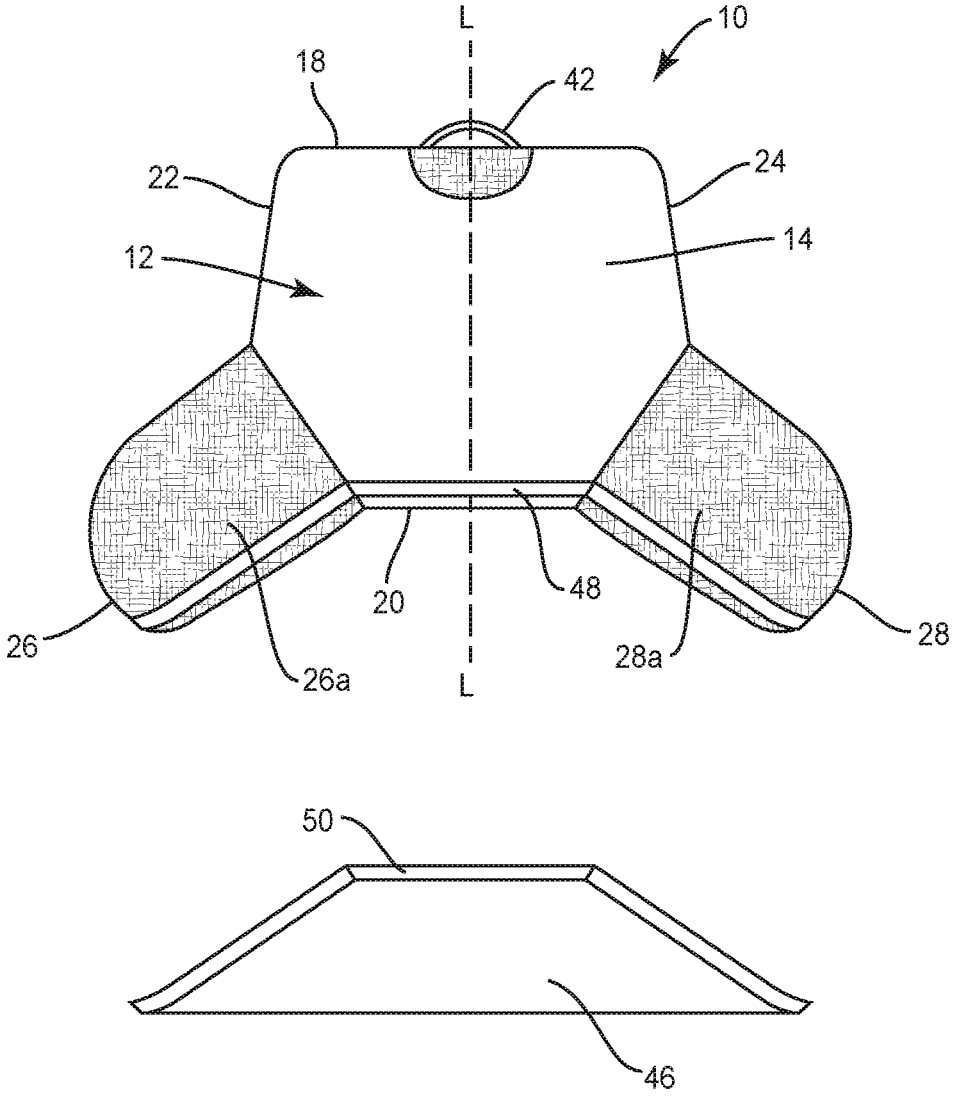
FIG. 8 is a perspective view of one embodiment of a pillow in accordance with the principles of the present disclosure, with parts separated.
Figure 9:
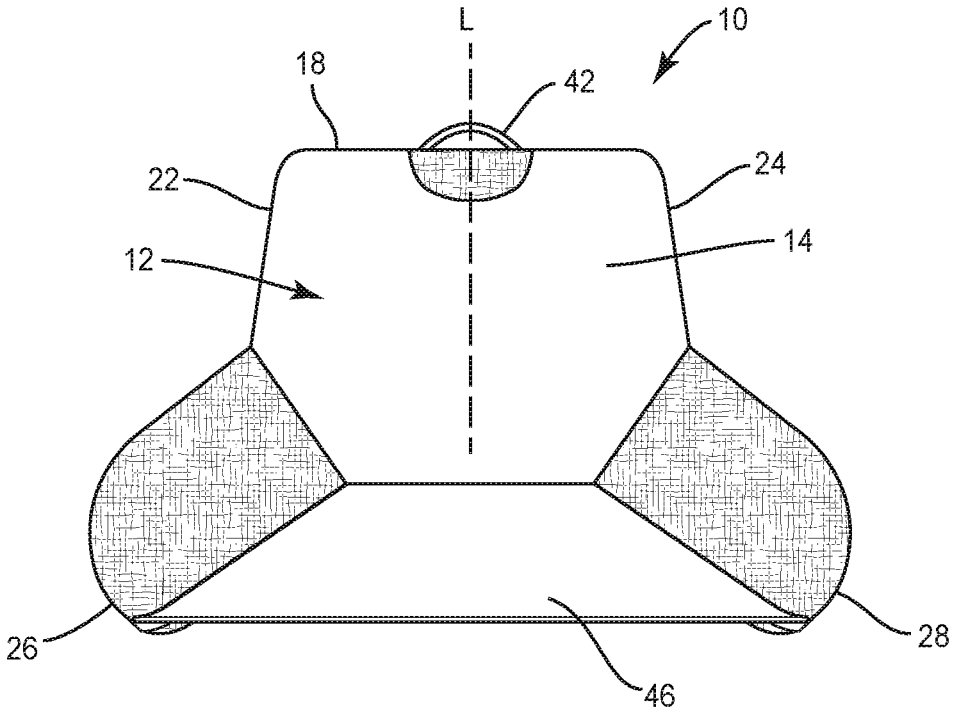
FIG. 9 is a perspective view of the pillow shown in FIG. 8.

In some embodiments, pillow 10 includes a seat cushion 46, as shown in FIGS. 8 and 9. A first fastening element 48 extends across arms 26, 28 and front surface 14. First fastening element 48 is configured to engage a second fastening element 50 on seat cushion 46 to join seat cushion 46 with arms 26, 28 and back section 12, as shown in FIG. 9. In one embodiment, fastening elements 48, 50 form a zipper. In one embodiment, one of fastening elements 48, 50 is a hook fastener and the other of fastening elements 48, 50 is a loop fastener such that fastening elements 48, 50 form a hook and loop fastener, such as, for example, Velcro®. In some embodiments, fastening elements 48, 50 may include snaps, buttons, etc.

In some embodiments, pillow 10 is sized and dimensioned for use as a travel pillow, such as, for example, a pillow configured for use during an automobile or plane trip. In such embodiments, back section 12 is configured to support a user's neck and/or head and arms 26, 28 are configured to rest on the user's shoulders as back section 12 supports the user's neck and/or head. In some embodiments, at least one of arms 26, 28 has a height that is sufficient to at least partially cover the user's ears as back section 12 supports the user's neck and/or head to dampen ambient sound. In some embodiments, travel pillow 10 comprises a flexible band within travel pillow 10 that is configured to correct a position of the user's body frame. In some embodiments, the flexible band is a bendable wire. In some embodiments, the flexible band extends through back section 12 and at least one of arms 26, 28. In some embodiments, travel pillow 10 comprises a plurality of interior pockets, at least one of the interior pockets being filled with a first fill material and at least one of the interior pockets being filled with a second fill material that is different from the first fill material. In some embodiments, travel pillow 10 comprises a suction cup coupled to the outer surface of travel pillow 10. In some embodiments, the present disclosure includes a cover configured for disposal of travel pillow 10 to keep travel pillow 10 clean when traveling and not in use.

Figure 10:
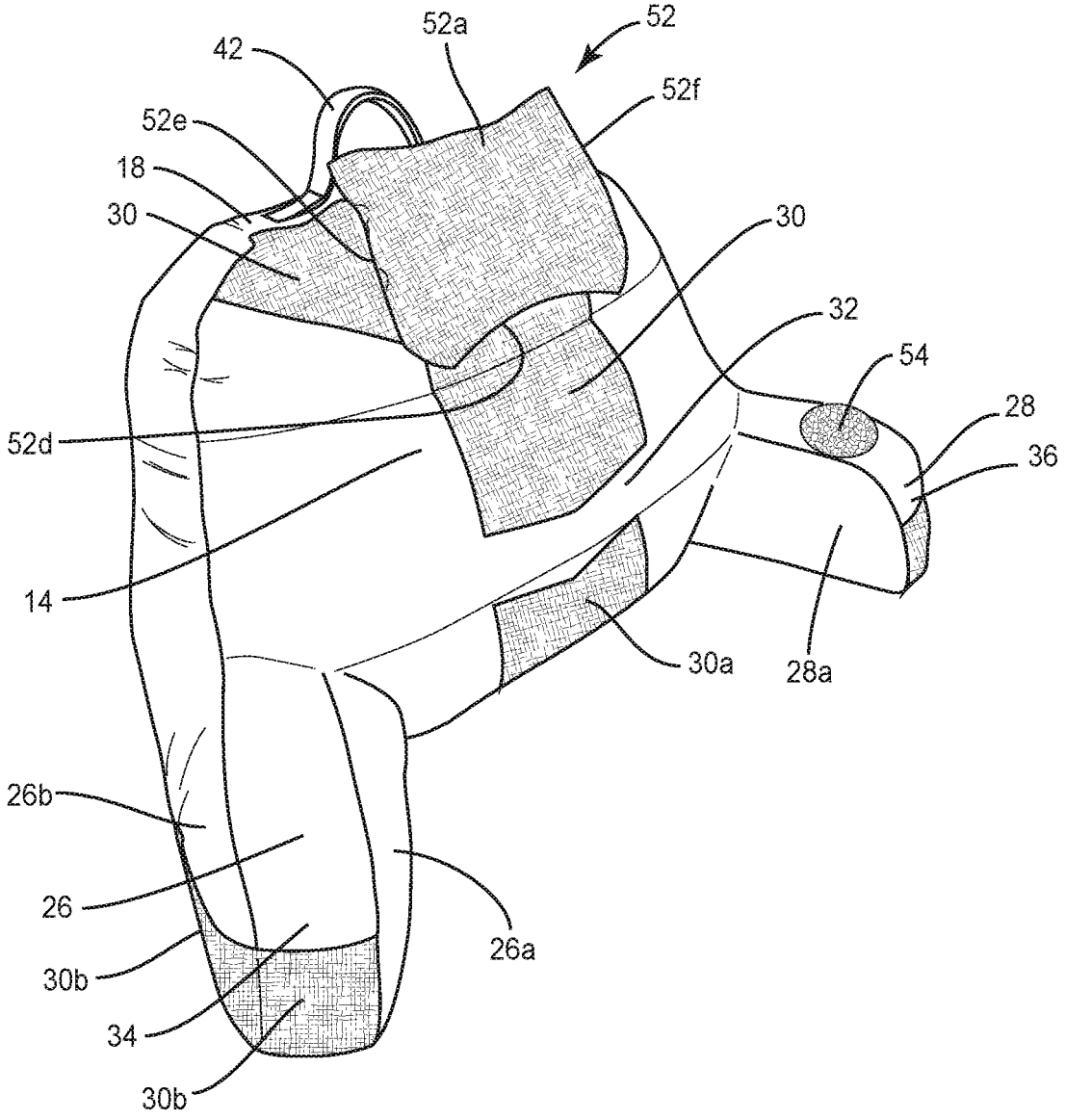
FIG. 10 is a perspective view of one embodiment of a pillow in accordance with the principles of the present disclosure.
Figure 11:
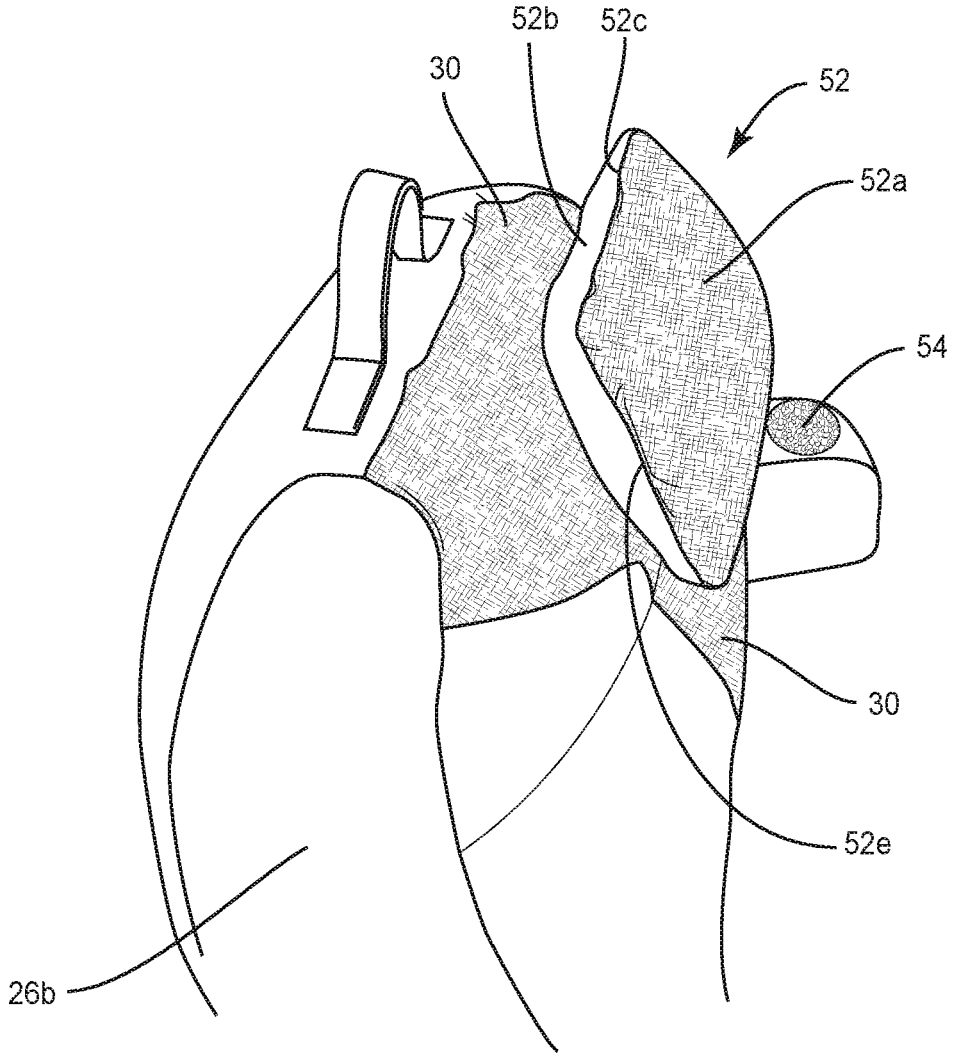
FIG. 11 is a perspective view of the pillow shown in FIG. 10.

In one embodiment, shown in FIGS. 10 and 11, inner surfaces 26*a*, 28*a* each comprise the second material. That is, neither of inner surfaces 26*a*, 28*a* include a first portion 30 comprising the first material, in contrast to the embodiments shown in FIGS. 1-9. Furthermore, side surfaces 22, 24 of pillow 10 shown in FIGS. 10 and 11 each comprise the second material. That is, neither of side surfaces 22, 24 include a first portion 30 comprising the first material, also in contrast to the embodiments shown in FIGS. 1-9.

Top surface 18 of pillow 10 shown in FIGS. 10 and 11 includes a first portion 30 that comprises the first material that is the same or similar to first portion(s) 30 and/or the first material discussed above with regard to the embodiments shown in FIGS. 1-9. First portion 30 in top surface extends onto front surface 14, as shown in FIGS. 10 and 11. Front surface 14 includes a first portion 30*a* that is spaced apart from first portion 30 in top surface that extends into front surface 14. First portion 30*a*, like first portion 30 of pillow 10 shown in FIGS. 10 and 11, comprises the first material. Front surface 14 includes a second portion 32 between first portion 30 on top surface and first portion 30*a* on front surface 14 that is the same or similar to second portion(s) 32 and/or the second material discussed above with regard to the embodiments shown in FIGS. 1-9. First portion 30*a* is positioned entirely on front surface 14. As such, there is a second portion 32 between first portion 30 in top surface that extends into front surface and first portion 30*a* that is positioned entirely on front surface 14. This second portion 32 comprises the second material.

Outer surfaces 26*b*, 28*b* of arms 26, 28 each include a first portion 30*b* that is made from the first material. First portions 30*b* each extend onto lateral end surfaces 34, 36 of arms 26, 28, as shown in FIGS. 10 and 11. Sections of pillow 10 between first portions 30*a* and 30*b* include the second material. That is, pillow comprises second portions 32 between first portions 30*a* and 30*b*. Likewise, sections of pillow 10 between first portions 30 and 30*b* include the second material. That is, pillow comprises second portions 32 between first portions 30 and 30*b*.

The configuration of first portions 30, 30*a*, 30*b* and second sections 32 of pillow shown in FIGS. 10 and 11 allows air to move into the interior cavity of pillow 10 through first portions 30 and 30*a* and exit the interior cavity through first portion 30*b*. However, it is envisioned that first portions 30, 30*a*, 30*b* can be variously arranged on pillow 10 to allow air, such as, for example, heated air from a user's body to enter the interior cavity of pillow 10 through at least one of first portions 30, 30*a*, 30*b* and then exit the interior cavity through another of first portions 30, 30*a*, 30*b*. It is envisioned that pillow 10 can include one or a plurality of first portions, such as, for example, first portions 30, 30*a*, 30*b*. It is further envisioned that all portions of pillow that do not include the first material can be made from the second material. It is further envisioned that pillow 10 may include one or a plurality of first portions in addition to first portions 30, 30*a*, 30*b*, which, like first portions 30, 30*a*, 30*b* may be variously arranged on pillow 10 to allow air, such as, for example, heated air from a user's body to enter the interior cavity of pillow 10 through at least one of the additional first portions and/or first portions 30, 30*a*, 30*b* and then exit the interior cavity through another of the additional first portions and/or first portions 30, 30*a*, 30*b*.

As shown in FIGS. 10 and 11, a headrest 52 may be attached to pillow 10. Headrest 52 is configured to provide support and/or cushioning for a user's back, neck and/or head when using pillow 10. Headrest 52 is attached to front panel 14 of pillow 10 and/or top surface 18 of pillow 10. In some embodiments, headrest 52 is removably attached to pillow 10. It is envisioned that headrest 52 may be removably attached to pillow 10 using hook and loop fasteners similar to fastening elements 48, 50 discussed above. It is envisioned that headrest 52 may be removably attached to pillow 10 using other types of fasteners, such as, for example, snaps or buttons. In some embodiments, headrest 52 is fixed relative to pillow 10. It is envisioned that headrest 52 may be fixed to pillow 10 using stitching, for example. Other means of fixing headrest 52 to pillow 10 are contemplated.

Headrest 52 includes a front panel 52*a* and an opposite back panel 52*b*. Front panel 52*a* is perimetrically joined and/or bound to back panel 52*b*. That is, the perimeter of front panel 52*a* engages the perimeter of back panel 52*b*. In some embodiments, front panel 52*a* is joined and/or attached to back panel 52*b* by stitching. Inner surfaces of front and back panels 52*a*, 52*b* define an interior cavity of headrest 52. The interior cavity of headrest 52 comprises a fill material positioned therein. In some embodiments, the interior cavity of headrest 52 comprises a fill material that is the same as the fill material positioned within the interior cavity of pillow 10. In some embodiments, the interior cavity of headrest 52 comprises a fill material that is different than the fill material positioned within the interior cavity of pillow 10.

In some embodiments, front panel 52*a* comprises the first material. In some embodiments, front panel 52*a* comprises the second material. In some embodiments, front panel 52*a* comprises a third material that is different from the first material and the second material. In some embodiments, back panel 52*b* comprise a material that is different from the material front panel 52*a* is made from. In some embodiments, back panel 52*b* comprises the same material that front panel 52*a* is made from. In some embodiments, back panel 52*b* comprises the first material. In some embodiments, back panel 52*b* comprises the second material. In some embodiments, back panel 52*b* comprises a third material that is different from the first material and the second material.

As shown in FIGS. 10 and 11, headrest 52 includes a top surface 52*c* and an opposite bottom surface 52*d*. Top and bottom surfaces 52*c*, 52*d* each extend between opposite first and second side surfaces 52*e*, 52*f*. In some embodiments, first and second side surfaces 52*e*, 52*f* each extend perpendicular to at least one of top and bottom surfaces 52*c*, 52*d*. In some embodiments, first and second side surfaces 52*e*, 52*f* each extend at an acute angle relative to at least one of top and bottom surfaces 52*c*, 52*d*. In some embodiments, headrest 52 has a rectangular or substantially rectangular configuration. In some embodiments, headrest 52 is tapered from bottom surface 52*d* to top surface 52*c*. In some embodiments, bottom surface 52*d* has an arcuate configuration. In some embodiments, bottom surface 52*d* is concavely curved between first and second side surfaces 52*e*, 52*f*. In some embodiments, bottom surface 52*d* is continuously curved from first side surfaces 52*e* to second side surface 52*f*.

As shown in FIGS. 10 and 11, pillow 10 may include a mat 54. Mat 54 is configured to hold a plurality of different items, such as, for example, a phone, tablet or other device. Pillow 10 may include one or a plurality of mats 54. Mat 54 may be positioned on the top surface of at least one of arms 26, 28. In some embodiments, mat 54 is removably attached to pillow 10. It is envisioned that mat 54 may be removably attached to pillow 10 using hook and loop fasteners similar to fastening elements 48, 50 discussed above. It is envisioned that mat 54 may be removably attached to pillow 10 using other types of fasteners, such as, for example, snaps or buttons. In some embodiments, mat 54 is fixed relative to pillow 10. It is envisioned that mat 54 may be fixed to pillow 10 using stitching, for example. Other means of fixing mat 54 to pillow 10 are contemplated.

In some embodiments, mat 54 comprises a material configured to prevent items from slipping off of mat 54. For example, mat 54 may comprise rubber and/or silicone. In some embodiments, mat 54 may include one or a plurality of features to prevent items from slipping off of mat 54. For example, mat 54 may include a plurality of bumps or protrusions, as shown in FIGS. 10 and 11.

Mat 54 has a circular configuration. However, all or only a portion of mat 54 may be variously shaped, such as, for example, oval, oblong, triangular, square, polygonal, irregular, uniform, non-uniform, offset, staggered, undulating, arcuate, variable and/or tapered. Mat 54 is shown as covering a portion of the top surface of one of arms 26, 28. However, it is envisioned that mat 54 may cover all or only a portion of the top surface of one of arms 26, 28.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A pillow comprising:

a back section comprising opposite front and back surfaces that each extend between opposite top and bottom surfaces, the surfaces each extending between opposite first and second side surfaces; and spaced apart first and second arms that each extend outwardly from the front surface, the first arm comprising an inner surface and an opposite outer surface that is continuous with the first side surface, the second arm comprising an inner surface and an opposite outer surface that is continuous with the second side surface, the inner surfaces being continuous with the front surface, wherein the inner surfaces and a first portion of the front surface are each made from a first material and the outer surfaces and a second portion of the front surface are made from a second material that is different from the first material, the first portion directly engaging the back surface, the second portion of the front surface extending continuously from an interface between the front surface and the inner surface of the first arm to an interface between the front surface and the inner surface of the second arm.

2. A pillow as recited in claim 1, wherein the first material is 3D mesh fabric.

3. A pillow as recited in claim 1, wherein the first material has a porosity that is greater than that of the second material.

4. A pillow as recited in claim 1, wherein the first portion of the front surface is made from the second material.

5. A pillow as recited in claim 1, wherein the pillow is configured such that air moves into an interior cavity of the pillow through the inner surfaces and exits the cavity through the outer surfaces.

6. A pillow as recited in claim 1, wherein the pillow comprises a first pocket that extends from the first side surface to a lateral end surface of the first arm, the lateral end surface of the first arm extending from the inner surface of the first arm to the outer surface of the first arm, the lateral end surface being made from the second material.

7. A pillow as recited in claim 6, wherein the pillow comprises a second pocket that extends from the second side surface to a lateral end surface of the second arm, the lateral end surface of the second arm extending from the inner surface of the second arm to the outer surface of the second arm, the lateral end surface of the second arm being made from the second material.

8. A pillow as recited in claim 1, wherein the back section has a height that is greater than that of the arms.

9. A pillow comprising the backrest pillow recited in claim 1, wherein the back section is configured to support a user's neck and the arms are configured to rest on the user's shoulders as the back section supports the user's neck.

10. A pillow as recited in claim 1, wherein the back surface comprises a first panel, a handle being coupled to the first panel, the front surface comprising a second panel and a third panel, the second and third panels each directly engaging the first panel, the second panel defining the first portion of the front surface, the third panel defining the second portion of the front surface.

11. A pillow as recited in claim 10, wherein the first panel is made from the first material.

12. A pillow as recited in claim 10, wherein the third panel includes opposite first and second ends and a gap between the first end and the second end, the second panel being positioned in the gap, the first and second ends each directly engaging the first panel.

13. A pillow as recited in claim 1, wherein the first portion is spaced apart from the bottom surface by the second portion.

14. A pillow comprising:

a back section comprising opposite front and back walls that each extend between opposite top and bottom walls, the walls each extending between opposite first and second side surfaces; and spaced apart first and second arms that each extend outwardly from the front wall, outer surfaces of the arms each being continuous with one of the side surfaces, inner surfaces of the arms each being continuous with the front wall, wherein the inner surfaces and a first portion of the front wall each consist of a first material and the outer surfaces and a second section of the first wall each consist of a second material that is different from the first material, the first portion directly engaging the back wall, the second portion of the front wall extending continuously from an interface between the front wall and the inner surface of the first arm to an interface between the front wall and the inner surface of the second arm, wherein the inner surfaces and the first portion are free of the second material and the outer surfaces and the second portion are free of the first material.

15. A travel pillow as recited in claim 14, wherein the first material has a porosity that is greater than that of the second material.

16. A pillow comprising:

a back section comprising opposite front and back walls that each extend between opposite top and bottom walls, the walls each extending between opposite first and second side surfaces; and spaced apart first and second arms that each extend outwardly from the front wall, outer surfaces of the arms each being continuous with one of the side surfaces, inner surfaces of the arms each being continuous with the front wall, wherein the inner surfaces and a first portion of the front wall each consist of a single first material and the outer surfaces and a second portion of the front wall each consist of a single second material that is different from the first material, the first portion directly engaging the back wall, the second portion of the front wall extending continuously from an interface between the front wall and the inner surface of the first arm to an interface between the front wall and the inner surface of the second arm, wherein the first material and the second material are each a fabric consisting of a material selected from the group consisting of acrylic, acetate, cotton, linen, silk, wool, nylon, rayon, spandex, lycra, hemp, and natural materials.

17. A pillow as recited in claim 16, wherein the first material is a 3D mesh fabric.

18. A pillow as recited in claim 16, wherein the first material has a porosity that is greater than that of the second material.

19. A pillow as recited in claim 16, wherein the first portion of the front wall is positioned between the top wall and the bottom wall and between the first side surface and the second side surface.

20. A pillow as recited in claim 16, wherein the back wall comprises a first panel, a handle being coupled to the first panel, the front wall comprising a second panel and a third panel, the second and third panels each directly engaging the first panel, the second panel defining the first portion of the front wall, the third panel defining the second portion of the front wall.

* * * * *